US009565941B2

(12) United States Patent
Peer et al.

(10) Patent No.: US 9,565,941 B2
(45) Date of Patent: Feb. 14, 2017

(54) HINGE LOCKING MEMBER

(71) Applicant: Grass America, Inc., Kernersville, NC (US)

(72) Inventors: Manfred Peer, Walkertown, NC (US); Cheng Jiang, Kernersville, NC (US); Georg Domenig, Kernersville, NC (US)

(73) Assignee: Grass America, Inc., Kernersville, NC (US)

( * ) Notice: Subject to any disclaimer, the term of this patent is extended or adjusted under 35 U.S.C. 154(b) by 161 days.

(21) Appl. No.: 14/283,664

(22) Filed: May 21, 2014

(65) Prior Publication Data

US 2015/0337577 A1 Nov. 26, 2015

(51) Int. Cl.

| | |
|---|---|
| ***E05D 7/04*** | (2006.01) |
| ***A47B 96/00*** | (2006.01) |
| ***E05D 3/02*** | (2006.01) |

(52) U.S. Cl.

CPC ..... *A47B 96/00* (2013.01); *E05D 3/02* (2013.01); *E05D 7/0415* (2013.01); *E05D 7/0423* (2013.01); *E05D 7/0407* (2013.01); *E05Y 2800/404* (2013.01); *E05Y 2900/20* (2013.01); *Y10T 16/5322* (2015.01); *Y10T 16/5326* (2015.01)

(58) Field of Classification Search

CPC .. E05D 2007/0476; E05D 7/0009; E05D 7/04; Y10T 16/5322; Y10T 16/5326; E05Y 2900/20

See application file for complete search history.

(56) References Cited

U.S. PATENT DOCUMENTS

| | | | | |
|---|---|---|---|---|
| 5,604,956 | A | 2/1997 | Grass | |
| 5,621,947 | A * | 4/1997 | Fitz | E05D 7/0423 16/240 |
| 5,819,371 | A * | 10/1998 | Rock | E05D 7/123 16/258 |
| 6,647,591 | B1 | 11/2003 | Domenig et al. | |
| 6,996,877 | B2 | 2/2006 | Booker et al. | |
| 7,117,561 | B1 | 10/2006 | Domenig et al. | |
| 7,231,691 | B1 * | 6/2007 | Domenig | E05D 7/0407 16/236 |
| 8,505,165 | B2 | 8/2013 | Domenig et al. | |
| 8,683,652 | B2 * | 4/2014 | Hagspiel | E05D 7/0407 16/236 |
| 2015/0315832 | A1 * | 11/2015 | Wu | E05F 1/1215 16/54 |

OTHER PUBLICATIONS

U.S. Appl. No. 14/283,627, filed May 21, 2014, Peer et al.

* cited by examiner

*Primary Examiner* — Victor Batson
*Assistant Examiner* — Matthew Sullivan
(74) *Attorney, Agent, or Firm* — Burr & Brown, PLLC

(57) ABSTRACT

A hinge is provided, including a base plate, a hinge arm movably associated with the base plate, an adjustment cam for adjusting a displacement of the hinge arm relative to the base plate, and a locking member for preventing the hinge arm from fully disassociating with the base plate, located immediately adjacent the adjustment cam, and adapted to connect the base plate to the hinge arm in a manner that does not interfere with a range of motion provided by the adjustment cam if the adjustment cam device experiences uncontrolled displacement.

12 Claims, 6 Drawing Sheets

HINGE LOCKING MEMBER

FIELD OF THE INVENTION

The present invention relates to hinges for use in connection with furniture, in particular, to hinges equipped with a locking member for preventing the hinge arm of the hinge from fully disassociating with the base plate of the hinge in the event that the adjustment mechanism, which otherwise controls the displacement therebetween, experiences failure or exceeds the predetermined adjustment tolerances.

BACKGROUND OF THE INVENTION

When furniture, such as cabinets, for example, have movable parts such as doors, those movable parts are often mounted to the furniture body using a movable member like a hinge. Examples of such hinges can be found, for instance, in Applicant's U.S. Pat. Nos. 5,604,956, 6,647,591, 6,996,877, and 7,117,561, the entireties of which are incorporated herein. U.S. Pat. No. 8,683,652 (hereinafter the '652 patent) also discloses a conventionally known hinge.

In these types of hinges, the base plate of the hinge is fixedly attached (mounted) to the body of the furniture piece, and the hinge cup is likewise fixedly attached to the movable part of the furniture piece, such as the door, and the two are hingeably connected to one another by a hinge arm that is adjustably fixed to the base plate so that the position of the door relative to the furniture body can be manipulated. For example, this adjustable fixation is typically accomplished using one or more adjustment members, such as a rotatable cam to control the depth direction or spacing between the door and the furniture, a height adjustment cam, and a side adjustment member to adjust the side position of the door relative to the furniture.

While the intended situation ideally involves providing controlled displacement between the hinge arm and the base plate over a predetermined range to manipulate the position of the door relative to the furniture, failure of the depth adjustment member can cause uncontrolled displacement, which, in turn, can cause the side adjustment member to become undesirably displaced, as well. In some circumstances, the hinge arm can become fully disassociated from the base plate, and the hinge itself, or even the entire door, can detach and fall off the furniture, which poses the danger of injury to people and objects nearby, and creates a furniture repair and/or replacement expense.

An attempt to prevent hinge arm disassociation was proposed by the locking mechanisms disclosed in '652 patent. While those locking mechanisms do not necessarily interfere with the normal operation of the adjustment member, the various embodiments instead pose different challenges. That is, one embodiment requires the provision of corresponding structural modifications to both the hinge arm and the base plate, and other embodiments require the provision of additional pieces, such as brackets or tensile-force resistant bands, as well as additional manufacturing steps and costs to implement those extra members.

In view of the above, it would be desirable to provide a hinge having a locking feature to prevent the disassociation of hinge components, but which does not require separate additional parts, complex structural modifications or expensive manufacturing steps, and which does not interfere with the normal operation of the depth adjustment member.

SUMMARY OF THE INVENTION

It is an object of the present invention to provide a hinge having a locking member that prevents the hinge arm of the hinge from fully disassociating with the base plate of the hinge without interfering with the normal operation of the depth adjustment member, which does not involve the addition of complicated structural features or extra parts, and which does not involve numerous additional manufacturing steps or increase the cost of the hinge.

According to one aspect of the present invention, a hinge is provided, comprising a base plate, a hinge arm movably associated with the base plate, and a locking member for preventing the hinge arm from fully disassociating with the base plate. The hinge further comprises an adjusting device for adjusting a displacement of the hinge arm relative to the base plate. Preferably, the locking member extends from the hinge arm and engages a portion of the base plate immediately adjacent the adjusting device if the adjusting device experiences uncontrolled displacement. It is also preferred that the adjusting device passes through coaxially aligned openings provide in the base plate and the hinge arm, and that the locking member extends from the opening in the hinge arm and engages a portion of the base plate immediately adjacent the adjusting device if the adjusting device experiences uncontrolled displacement.

According to another aspect of the present invention, a hinge is provided, comprising a base plate, a hinge arm movably associated with the base plate, an adjustment cam for adjusting a displacement of the hinge arm relative to the base plate, and a locking member located immediately adjacent the adjustment cam and adapted to connect the base plate to the hinge arm in a manner that does not interfere with a range of motion provided by the adjustment cam if the adjusting device experiences uncontrolled displacement. It is preferred that the base plate further comprises an adjustment cam seat portion having an opening therein through which the adjustment cam passes, the hinge arm further comprises an adjustment cam portion having an opening therein through which the adjustment cam passes, and the openings are coaxially aligned. Preferably, an inner diameter of the opening in the hinge arm adjustment cam portion is larger than an outer diameter of the opening in the base plate adjustment cam seat portion.

The locking member extends through the opening of the hinge arm adjustment cam portion. Preferably, the locking member further comprises a hooked portion at a distal end thereof that is adapted to engage a lower surface of the adjustment cam seat portion.

According to another aspect of the present invention, a hinge is provided, comprising a base plate having a main body portion and a raised portion extending upwardly from one end of the main body portion in a vertical direction, the raised portion having a through hole formed therein passing from a first surface thereof to an opposed second surface thereof in the vertical direction, a hinge arm movably associated with the base plate and having a main body portion with a swing arm extending from a first end thereof and a though hole formed in an opposed second end thereof, the through hole passing from a first surface thereof to an opposed second surface thereof in the vertical direction, and a locking member extending from at first end at the first surface of the hinge arm, through the through hole of the hinge arm and toward an opposed second end thereof proximate the second surface of the raised portion of the base plate vertical direction. The hinge further comprises an adjustment cam located within the respective through holes of the base plate and the hinge arm, and the locking member is preferably located immediately adjacent the adjustment cam.

Preferably, the second end of the locking member has a hook shape, and an upper surface of the hook shape of the second end of the locking member is adapted to securely engage the second surface of the raised portion of the base plate when a predetermined gap between the upper surface of the hook shape of the second end of the locking member and the second surface of the raised portion of the base plate in the vertical direction is removed by the relative displacement of the base plate and the hinge arm.

BRIEF DESCRIPTION OF THE DRAWINGS

For a better understanding of the nature and objects of the invention, reference should be made to the following detailed description of a preferred mode of practicing the invention, read in connection with the accompanying drawings, in which.

DETAILED DESCRIPTION OF THE INVENTION

Figure 1:
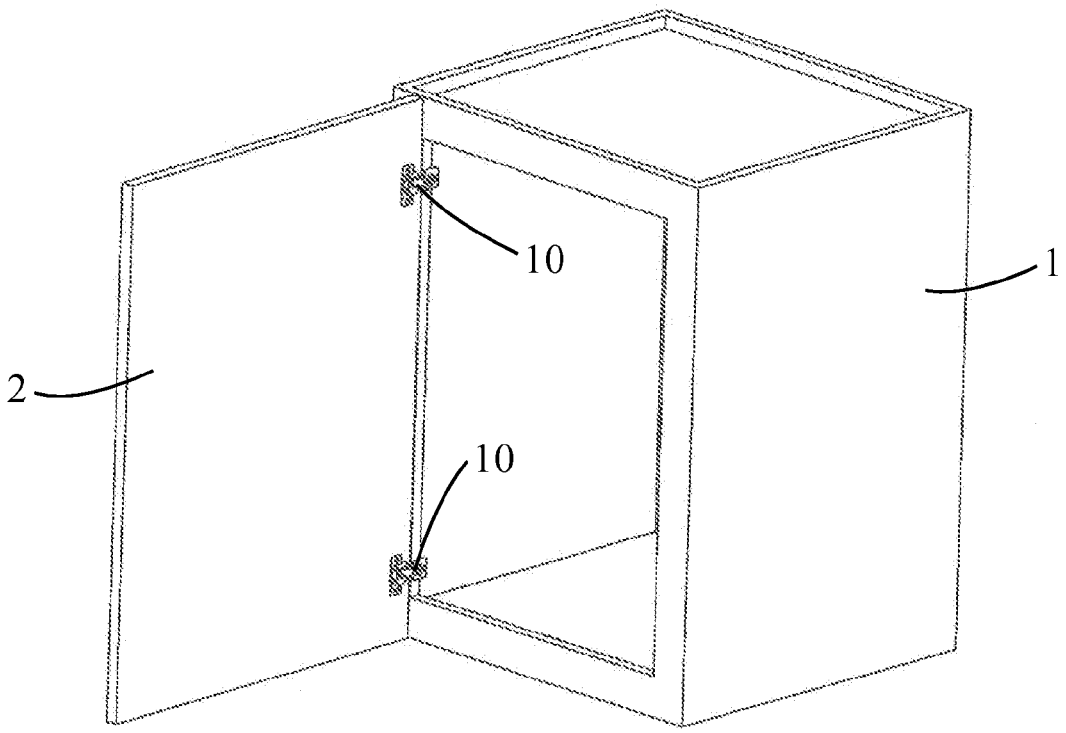
FIG. 1 is a perspective view of a furniture member (i.e., a cabinet) whose door is movably mounted thereto using hinges according to the present invention.
Figure 2A:
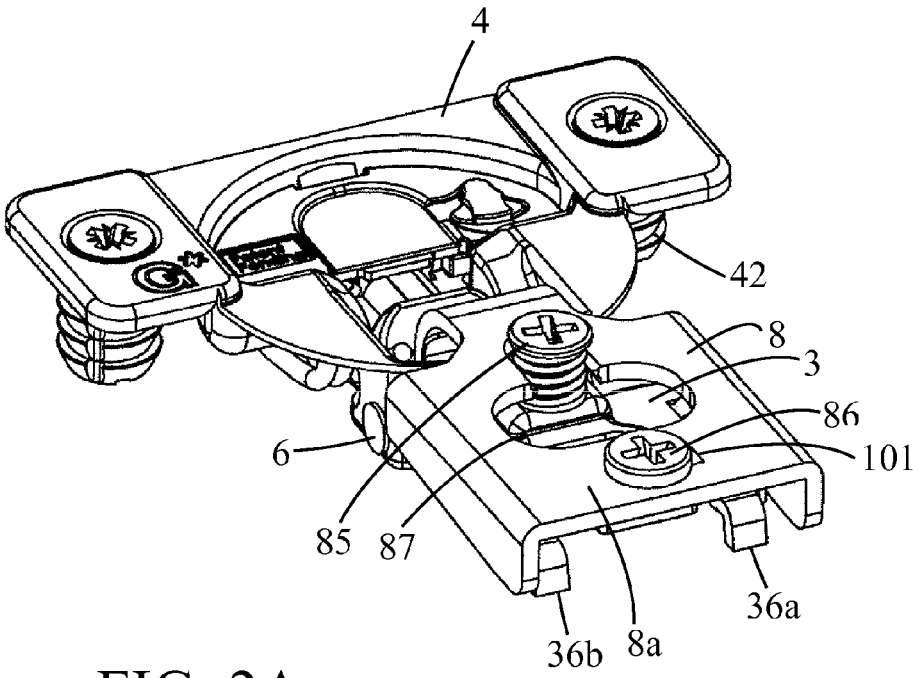
FIG. 2A is a perspective top view of a hinge according to the present invention.
Figure 2B:
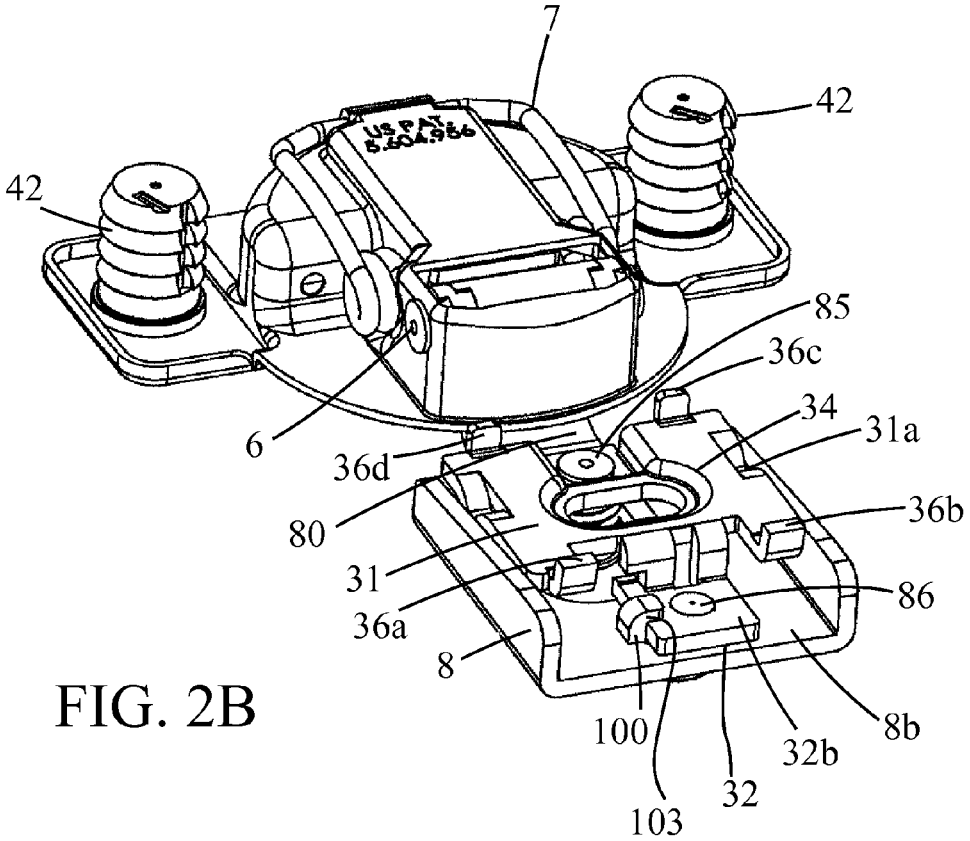
FIG. 2B is a perspective bottom view of the hinge shown in FIG. 2A.
Figure 3:
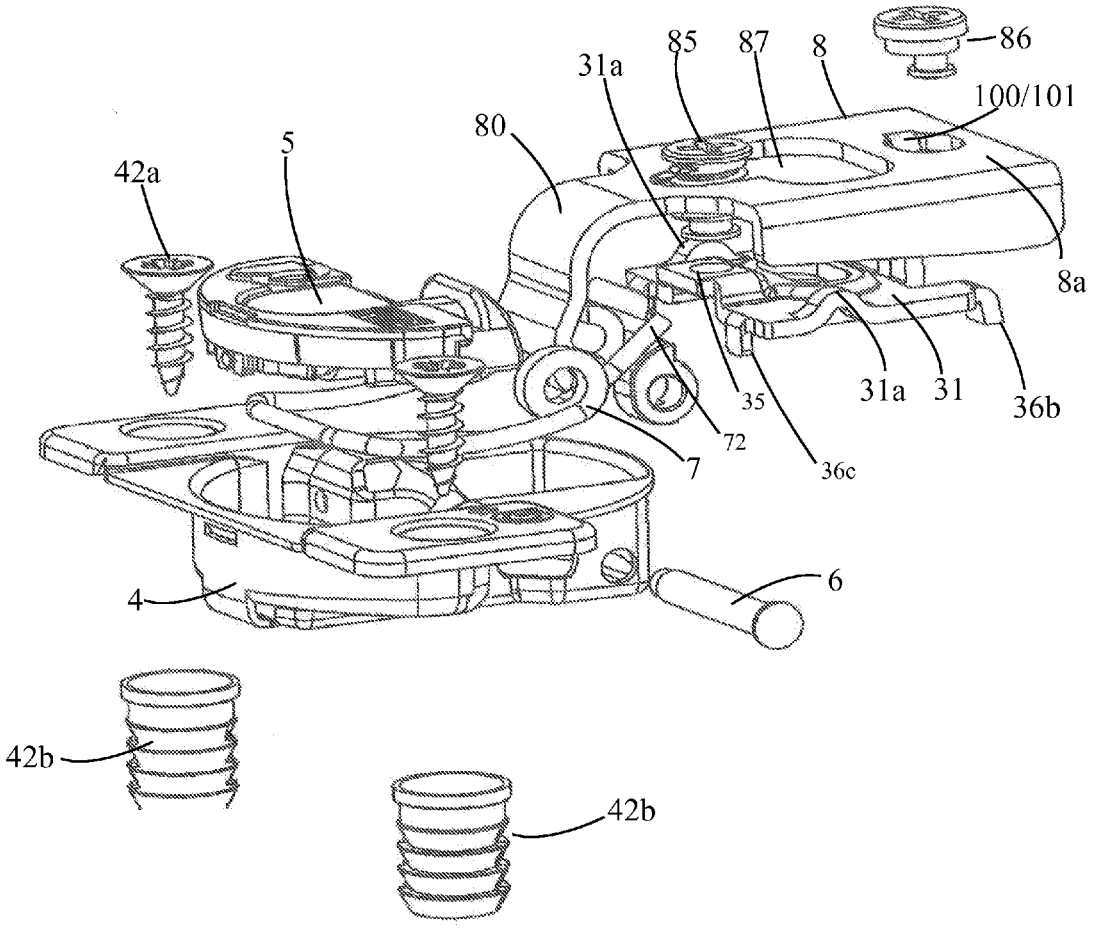
FIG. 3 is an exploded perspective view of the hinge shown in FIGS. 2A and 2B.

FIG. 1 is a perspective view of a cabinet 1 whose door 2 is movably mounted thereto via hinges 10 according to the present invention. FIG. 2A is a perspective top view of a hinge 10 according to the present invention, and FIG. 2B is a perspective bottom view of the hinge 10 shown in FIG. 2A. The hinge 10 includes base plate 3, hinge cup 4 and hinge arm 8. As shown in FIG. 3, the hinge cup 4 is functionally connected to the hinge lever 80 (swing arm) of the hinge arm 8 via the control pin 6 in connection with the spring 7, and further in conjunction with the plastic insert 9, as described in more detail in Copending patent application Ser. No. 14/283,627, the entirety of which is incorporated herein by reference. The hinge cup 4 is adapted to be fixed to the door 2 using fixation members 42, for example (i.e., screw 42*a* and threaded sleeve 42*b*; see also FIG. 3).

FIG. 3 also shows other components of the hinge 10 according to the present invention, such as the damping mechanism 5, which is located within the hinge cup 4, and which is provided to control the closing speed of the movable furniture member to which the hinge is attached (i.e., the cabinet door 2). Suitable damping mechanisms that can be used are disclosed, for example, in Applicant's U.S. Pat. No. 8,505,165, the entire disclosure of which is incorporated herein by reference.

The hinge arm 8 is adjustably connected to the base plate 3 via the adjustment cam 86 for adjusting the displacement of the hinge arm 8 relative to the base plate 3 (depth adjustment), and via the side adjustment member 85. While it is not shown in the drawings, it is also possible to provide another height adjustment cam between the depth adjustment cam 86 and the side adjustment member 85, as one skilled in the art would understand.

Figure 4:
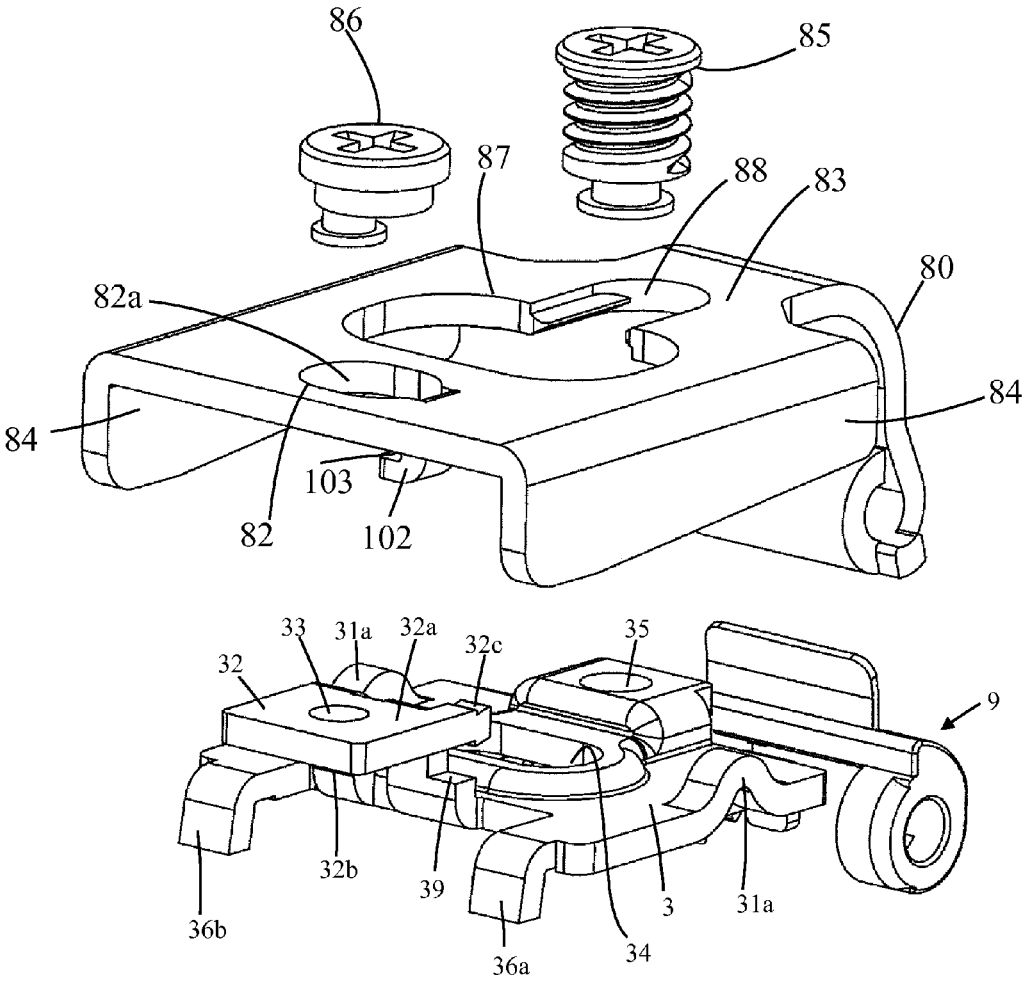
FIG. 4 is a perspective pre-assembly (top) view of a hinge arm and base plate portion of the hinge according to the present invention.

As shown in FIGS. 3 and 4, the base plate 3 has a main body portion 31 from which a plurality of stabilization legs 36*a*-36*d* extend. The main body portion 31 also includes a pair of laterally opposed raised portions 31*a*, which are stamped-up parts provided on either side of the base plate main body portion 31, for example, that serve as spacers for controlling the distance between the base plate 3 and the hinge arm 8, whereby the surfaces of the peak portions of the raised portions 31*a* of the base plate 3 contact the lower surface 8*b* of the hinge arm 8.

The base plate 3 also includes a raised portion 32, which is also referred to as the adjustment cam seat portion 32, that extends upwardly and outwardly from one end of the main body portion 31 in both the vertical (raised up) direction and longitudinal (extends lengthwise outwardly) direction. The raised portion 32 includes an extension part or leg 32*c* that extends in the longitudinal direction toward the central opening 34 and which includes an indented or dimpled end portion. The dimpled extension leg 32*c* is a mechanical feature that assists in the assembly of the hinge and prevents disassociation of the hinge parts, as described in more detail below.

The through hole 33 of the raised portion 32 of the base plate 3 passes from the first (upper) surface 32*a* of the raised portion 32 of the base plate 3 to the second (lower) surface 32*b* of the raised portion 32 of the base plate 3, and is also referred to as the adjustment member (adjustment cam) opening 33. Through hole 35, also referred to as the lateral adjustment member (screw) opening 35, is located on the longitudinally opposed side of the base plate 3 with respect to through hole 33, proximate the hinge lever 80 of the hinge arm 8 when assembled (see, e.g., FIG. 2A). A central opening 34 is also provided in the base plate 3 for fixing the base plate 3 to the cabinet 1.

The hinge arm 8 has a main portion 83, at one longitudinal end of which the swing arm or hinge lever 80 extends, and from which a pair of laterally opposed side panels 84 also extend (i.e., downwardly) in the vertical direction along the longitudinal length of the hinge arm main portion 83. The central opening 87 communicates with the slotted opening 88 for receiving the side adjustment member 85 proximate the hinge lever 80, the slotted part of which has an elongate U-shape to act as a guideway for the side adjustment member 85 and to provide tolerance for the required adjustments. The through hole 82 for receiving the adjustment member 86 is located at the other end of the main portion 83 of the hinge arm 8 (i.e., the hinge arm adjustment member/cam portion), which is longitudinally opposed with respect to the hinge lever 80. The through hole 82 passes from the first (upper) surface 8*a* to the second (lower) surface 8*b* of the hinge arm 8 and has an inner surface 82*a* defining an inner diameter of the through hole 82.

The though hole 82 of the hinge arm 8 substantially coaxially aligns with the through hole 33 in the raised portion 32 for accommodating the adjustment member 86, and at least a portion of the slotted opening 88 in the hinge arm aligns with the though hole 35 in the base plate 3 for accommodating the side adjustment member 85. The central openings 87 and 34 also align coaxially to facilitate fixation of the base plate 3 to the cabinet 1.

The locking member 100 extends downwardly in the vertical direction from a first end 101 at the upper surface 8*a* of the hinge arm 8, at a peripheral portion of the through hole 82 and along the inner surface 82*a* of the though hole 82 of the hinge arm 8, down toward an opposed second (distal) end 102, which is located below the raised portion 32 of the base plate 3, proximate the lower surface 32*b* of the raised portion 32. That is, as shown in FIG. 4, a portion of the upper surface 8*a* of the hinge arm 8 is shaped/punched from an area of the hinge arm 8 that would have otherwise been removed when the though hole 82 is formed, and is bent downwardly in the vertical direction, through and along the edge of the though hole 82, to define the locking member 100. The distal end 102 of the locking member 100 has a hooked portion 103, the surface 104 of which will engage the lower surface 32*b* of the raised portion 32 of the base plate 3 if the adjustment member 86 is defective or experiences failure (uncontrolled displacement) in order to prevent the hinge arm 8 from fully disassociating from the base plate 3.

In order to form the assembled structure shown in FIGS. 2A and 2B, the hinge arm 8 is lowered onto the base plate as permitted by the raised portions 31*a*, and the hooked portion 103 of the distal end 102 of the locking member 100 is guided through the notch 39 (see FIG. 4) and into place spaced a distance beneath the raised portion 32 of the base plate 3. Thereafter, the provision of the dimpled extension 32*c* makes it impossible for the locking member 100 to move backward through the notch 39 in the opposite direction (opposite to the insertion assembly direction).

The adjustment members 85, 86 are threaded into their respective openings in the hinge arm 8 and through the base plate 3. The upper surface 104 of the hooked portion 103 does not contact the lower surface 32*b* of the raised portion 32, but remains spaced a distance therefrom in the vertical direction (i.e., at a predetermined gap) so that the adjustment member 86 is able to act freely within the desired adjustment tolerances of the cam mechanism 86. That is, the upper surface 104 of the hook portion 103 of the distal end 102 of the locking member 100 is adapted to securely engage the second surface 32*a* of the raised portion 32 of the base plate 3 only when the predetermined gap between the upper surface 104 of the hook portion 103 of the locking member 100 and the second surface 32*b* of the raised portion 32 of the base plate in the vertical direction is removed by the relative displacement of the base plate 3 and the hinge arm 8.

The vertical distance between the upper surface 104 of the hook portion 103 of the locking member 100 and the lower surface 32*b* of the raised portion 32 of the base plate 3 (i.e., the predetermined gap) is determined by the length of the locking member 100. If the length is too short, the locking member 100 will engage the lower surface 32*b* of the raised portion 32, and potentially interfere with the intended operation of the adjustment member 86. If the length of the locking member 100 is too long, the locking member 100 may not correctly engage the lower surface 32*b* of the raised portion 32 in the event of a failure or uncontrolled displacement of the adjustment member 86, thus rendering the locking member 100 ineffective for its intended purpose.

The locking member 100 can be formed from the same metal sheet material as the hinge arm 8 as a singular piece, at the same time when the hinge arm 8 is initially formed, by any suitable metal forming method including, but not limited to, as punching, stamping, and deep draw forming, for example. In that manner, no additional manufacturing steps are needed, aside from the machining design to accommodate the forming of the shape of the piece to be the locking member 100 to be cut and punched. In that manner, no additional pieces are needed, because the locking member 100 is integral with the hinge arm 8. The hinge arm 8 can be made of any suitable metal, including, but not limited to, steel or zinc, for example. Likewise, the base plate can also be formed of any suitable metal material, examples of which include, but are not limited to, steel or zinc.

Figure 5A:
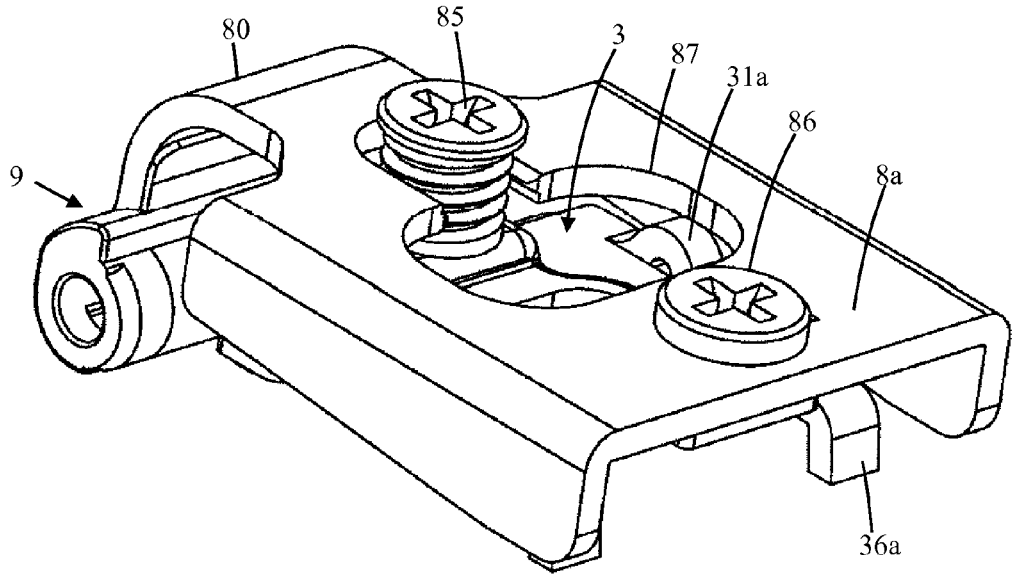
FIG. 5A is a perspective assembled top view of the hinge arm and base plate portion of the hinge shown in FIG. 4.
Figure 5B:
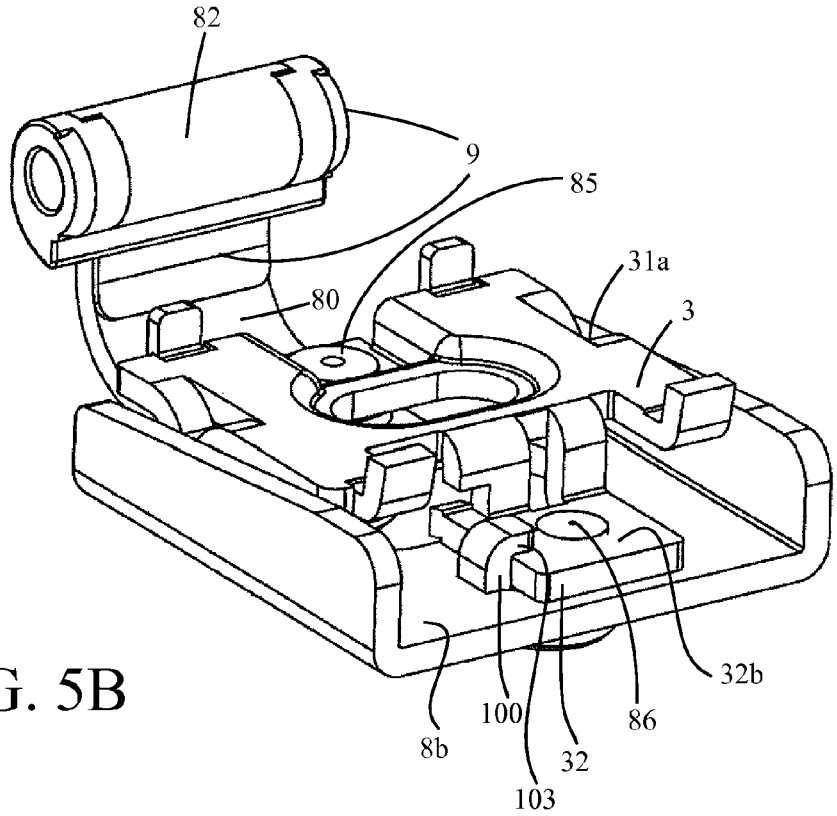
FIG. 5B is a perspective assembled bottom view of FIG. 5A.
Figure 6A:
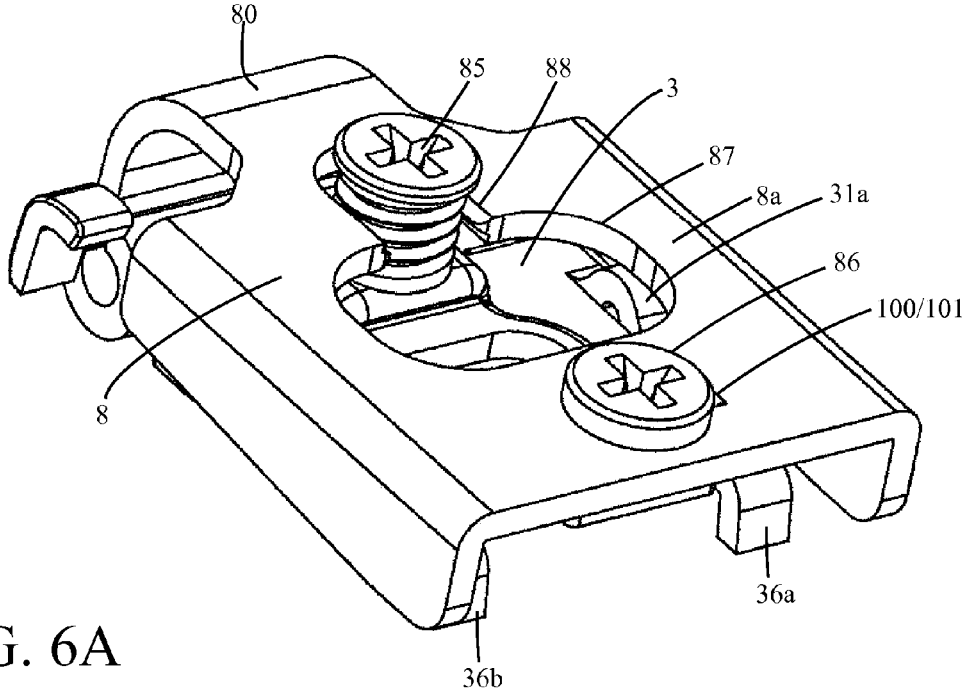
FIG. 6A is a perspective assembled top view of the hinge arm and base plate portion of the hinge shown in FIG. 4, but without the plastic insert member attached to the hinge lever.
Figure 6B:
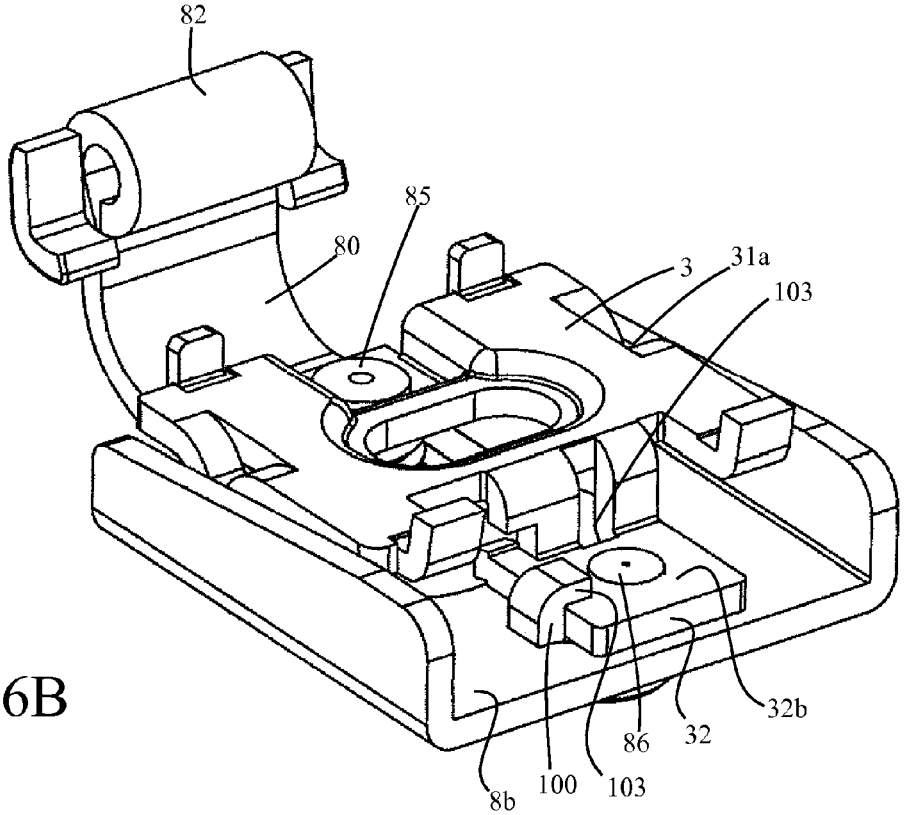
FIG. 6B is a perspective assembled bottom view of FIG. 6A.

FIG. 5A is a perspective assembled top view of the hinge arm 8 and base plate 3 portion of the hinge shown in FIG. 4, and FIG. 5B is a perspective assembled bottom view of FIG. 5A. It should be understood, however, that the presence or absence of the plastic insert 9 does not affect the structure or the functionality of the locking member 100, and that the hinge according to the present invention is not limited with respect to the insert 9. For example, FIG. 6A is a perspective assembled top view of the hinge arm and base plate portion of the hinge shown in FIG. 4, but without having the plastic insert member 9 attached to the end of the lever arm 80 of the hinge arm 8, and FIG. 6B is a perspective assembled bottom view of FIG. 6A. It can be seen that the only difference between FIGS. 5 and 6 relates to the presence or absence of the plastic insert 9. Repeat descriptions of like elements are omitted.

As shown and described above, the present invention provides a hinge having a locking feature that effectively prevents the disassociation of hinge components, which does not require separate additional parts, complex structural modifications or expensive manufacturing steps, and which does not interfere with the normal operation of the depth adjustment member. This innovative and effective solution overcomes the drawbacks associated with the prior art and represents an advancement in the state of the art.

While the present invention has been particularly shown and described with reference to the preferred mode as illustrated in the drawings, it will be understood by one skilled in the art that various changes in detail may be effected therein without departing from the spirit and scope of the invention as defined by the claims.

What is claimed:

1. A hinge comprising:

a base plate;

a hinge arm movably associated with the base plate;

an adjustment cam for adjusting a displacement of the hinge arm relative to the base plate; and a locking member located in a central portion of the hinge arm, immediately adjacent the adjustment cam, and which connects the base plate to the hinge arm in a manner that does not interfere with a range of motion provided by the adjustment cam if the adjusting device experiences uncontrolled displacement, wherein the adjustment cam is discrete with respect to the locking member.

2. The hinge according to claim 1, wherein the base plate further comprises an adjustment cam seat portion having an opening therein through which the adjustment cam passes, wherein the hinge arm further comprises an adjustment cam portion having an opening therein through which the adjustment cam passes, and wherein the openings are coaxially aligned.

3. The hinge according to claim 2, wherein an inner diameter of the opening in the hinge arm adjustment cam portion is larger than an outer diameter of the opening in the base plate adjustment cam seat portion.

4. The hinge according to claim 3, wherein the locking member extends through the opening of the hinge arm adjustment cam portion.

5. The hinge according to claim 4, wherein the locking member further comprises a hooked portion at a distal end thereof that is adapted to engage a lower surface of the adjustment cam seat portion if the adjusting device experiences uncontrolled displacement.

6. A hinge comprising:

a base plate having a main body portion and a raised portion extending upwardly from one end of the main body portion in a vertical direction, the raised portion having a through hole formed therein passing from a first surface thereof to an opposed second surface thereof in the vertical direction;

a hinge arm movably associated with the base plate and having a main body portion with a swing arm extending from a first end thereof and a though hole formed in an opposed second end thereof, the through hole passing from a first surface of the hinge arm to an opposed second surface thereof in the vertical direction; and a locking member extending from a first end at the first surface of the hinge arm, through the through hole of the hinge arm and toward an opposed second end thereof proximate the second surface of the raised portion of the base plate in the vertical direction.

7. The hinge according to claim 6, wherein the second end of the locking member has a hook shape.

8. The hinge according to claim 7, wherein an upper surface of the hook shape of the second end of the locking member is adapted to securely engage the second surface of the raised portion of the base plate when a predetermined gap between the upper surface of the hook shape of the second end of the locking member and the second surface of the raised portion of the base plate in the vertical direction is removed by the relative displacement of the base plate and the hinge arm.

9. The hinge according to claim 8, further comprising an adjustment cam located within the respective through holes of the base plate and the hinge arm.

10. The hinge according to claim 9, wherein the locking member is located immediately adjacent the adjustment cam.

11. A furniture piece comprising:

a furniture body; and a movable furniture member attached to the furniture body via a hinge according to claim 1.

12. A furniture piece comprising:

a furniture body; and a movable furniture member attached to the furniture body via a hinge according to claim 6.

* * * * *